US006296376B1

(12) United States Patent
Kondo et al.

(10) Patent No.: US 6,296,376 B1
(45) Date of Patent: Oct. 2, 2001

(54) LED LAMP HAVING A PRISMATICALLY-CUT MODIFIER

(75) Inventors: Toshiyuki Kondo, Funabashi; Yoshifumi Kawaguchi, Kawasaki; Tadashi Nomura, Hiratsuka; Nobumichi Aita, Fujisawa, all of (JP)

(73) Assignee: Stanley Electric Co., Ltd., Yokohama (JP)

( * ) Notice: Subject to any disclaimer, the term of this patent is extended or adjusted under 35 U.S.C. 154(b) by 0 days.

(21) Appl. No.: 09/372,755

(22) Filed: Aug. 11, 1999

(30) Foreign Application Priority Data

Aug. 12, 1998 (JP) ..... 10-228038

(51) Int. Cl.[7] ..... F21V 7/00

(52) U.S. Cl. ..... 362/310; 362/268; 362/297; 362/311; 362/317; 362/339; 362/307

(58) Field of Search ..... 362/227, 235, 362/236, 237, 244, 268, 296, 297, 307, 310, 311, 317, 326, 332, 339, 800

(56) References Cited

U.S. PATENT DOCUMENTS 4,935,665 * 6/1990 Murata ..... 313/500
4,965,488 * 10/1990 Hihi ..... 313/499
5,093,768 * 3/1992 Ohe ..... 362/241
5,515,253 * 5/1996 Sjobom ..... 362/244
5,939,996 * 8/1999 Kniveton et al. ..... 340/815.4

FOREIGN PATENT DOCUMENTS

Shou
62-269984 11/1987 (JP) .
Hei. 4-36588 6/1992 (JP) .
Hei. 4-36589 6/1992 (JP) .

* cited by examiner

*Primary Examiner*—Sandra O'Shea
*Assistant Examiner*—Ismael Negron
(74) *Attorney, Agent, or Firm*—Morgan, Lewis & Bockius LLP

(57) ABSTRACT

An LED lamp includes a first optical member and a second optical member. The first optical member is for providing light from an LED chip, provided with at least one of a concave mirror and a dome lens, at an appropriate illumination angle. The second optical member is a lens positioned to receive light from the first optical part via an air layer. At least one surface of the second optical member is a prismatically cut surface.

10 Claims, 2 Drawing Sheets

LED LAMP HAVING A PRISMATICALLY-CUT MODIFIER

This invention claims the benefit of Japanese Patent Application No. Hei 10-228038, filed on Aug. 12, 1998, which are incorporated by reference.

BACKGROUND OF THE INVENTION

1. Field of the Invention

The present invention relates to an LED lamp employing an LED chip that is a semiconductor light emitting device as a light source specifically provided with the object of providing LED lamp configuration applicable to uses in vehicle signal lights etc. demanding area-lighting with uniform brightness.

2. Description of Related Art

An example configuration of a related type of LED lamp 90 is shown in FIG. 6. An LED chip 91 is mounted within a horn section 92*a* provided in order to obtain reflection at a lead frame 92, light is reflected in a prescribed direction and the LED chip 91 is covered by a molded case 93 of transparent resin.

The object of the molded case 93 is to provide resistance to moisture and to provide light from the LED chip 91 including light reflected at the horn section 92*a* at an appropriate illuminating angle. A top part 93*a* of the molded case 93 therefore forms a convex lens and an illuminating angle γ of, for example, 30 to 40 degrees is provided.

In the related LED lamp 90 of the above configuration, the LED chip 91 is embedded within the molded case 93. The LED chip 91 is therefore subjected to stress due to the difference in the thermal expansion coefficients of the LED chip 91 and the molded case 93, and it is therefore extremely important to make the diameter of the molded case 93 approximately 5 mm or less.

When the LED lamp 90 is used as a light source for a vehicle light such as a rear light, a plurality of LED lamps 90 are adopted. However, the light emitting area of one LED lamp 90 is small and the illuminating angle is narrow. There is also a strong tendency for the luminance distribution to focus itself about a central line. It is therefore preferable to arrange a plurality of LED lamps 90 at a narrow pitch in order to provide a uniform intensity of illumination at the outer lens surface of a vehicle light.

However, if LED lamps are arranged in a small pitch at the rear surface of an outer lens of a vehicle light having a prescribed area, the number of LED lamps 90 required increases, which causes increasing costs. Further, when the pitch of the LED lamps 90 is narrow, the temperature within a light housing for the vehicle light increases, and the luminance of the LED lamps 90 decreases.

Further, there is a tendency of oversimplification for the vehicle lamp comprising the conventional LED lamp 90. Since the mold case 93 is a convex lens which must act as an optical means to obtain prescribed optical characteristics of the LED lamp 90, it is difficult for the mold case 93 to have any complicated shape such as a combination of pentagons, although such a complicated shape is required from aesthetic appearance of the vehicle light.

It is therefore the object of the present invention to provide an LED lamp that overcomes the above problems and which is applicable to uses in vehicle signal lights etc. demanding uniform brightness.

SUMMARY OF THE INVENTION

In order to achieve the aforementioned object, the present invention provides an LED lamp comprising a first optical section and a second optical section. The first optical section is for providing light, from an LED chip provided with at least one of a concave mirror and a dome lens, at an appropriate illuminating angle. The second optical section is positioned to receive light from the first optical section via an air layer and is shaped as a lens in such a manner that a composite focal point thereof substantially coincides with the position of the LED chip. At least one surface of the second optical means is a prismatically cut surface.

In the present invention, at least one type of second optical section is provided in a manner selectable on assembly of the LED lamp.

Further, the entire shape of the second optical section when viewed from the front is of such a shape that a plurality of the shapes can be arranged close to each other.

With the present invention, the diameter of the light emitting surface can easily be enlarged from approximately 5 mm at most in the related art to approximately 15 mm, the tendency for luminance to be large at a central line is alleviated and the luminance of the outer lens surface of a vehicle light taking LED lamps as a light source is made uniform. Visibility are therefore improved, and performance are also improved.

Further, aesthetic appearance of the vehicle light is also improved, as the present invention provides the second optical means separate from the first optical means, a wide variety of design changes can be catered for by preparing a plurality of types of second optical means and then selecting which is to be used or which types are to be used in combination. Design oversimplification that often occurred in related vehicle lights taking related LED lamps as a light source can therefore be prevented.

DETAILED DESCRIPTION OF THE PREFERRED EMBODIMENT

Figure 1:
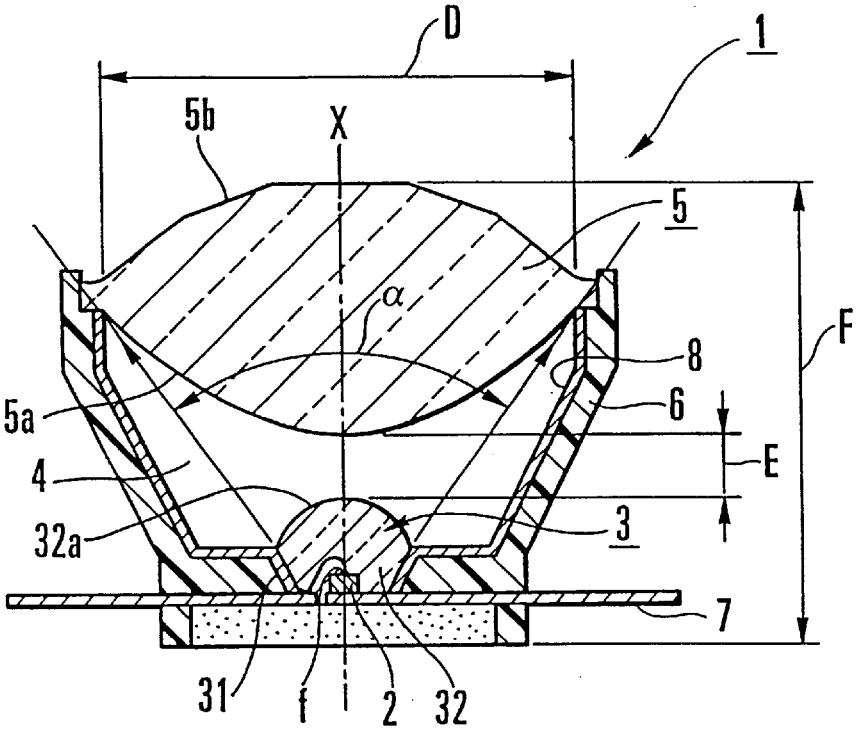
FIG. 1 is a cross-section showing a first embodiment of an LED lamp of the present invention.

The following is a detailed description of the present invention based on embodiments shown in the drawings. Whenever possible, same reference numbers will be used throughout the drawings to refer to the same or like parts.

FIG. 1 illustrates the first embodiment of the present invention. This LED lamp 1 is the same as the related example in that the LED chip 2 is adopted as a light source but differs in that the present invention is provided with a first optical means (or member) 3 and a second optical means (or member) 5 separated from the first optical means 3 by an air layer 4.

In this first embodiment, a concave mirror 31 and a dome lens 32*a* are adopted as the first optical means 3. The LED chip 2 is provided on the axis of rotation X of the concave mirror 31 formed, for example, as a rotating parabolic surface and is arranged back in the illuminating direction from a focal point f of the LED lamp 1 in such a manner that light emitted from the LED chip 2 is dispersed appropriately to an illuminating angle of α.

As it is necessary to protect the LED chip 2 from external environmental conditions such as moisture inside of the concave mirror 31, the LED chip is embedded in a case 32 made of a transparent resin. The light transmitting side of the case 32 can be a convex spherical lens or a convex aspherical lens so that the surface thereof constitutes the dome lens surface 32*a*.

Light emitted from the LED chip 2 consists of light that directly reaches the dome lens 32*a* and light that reaches the dome lens 32*a* after being reflected by the concave mirror 31. When light for either case described in the above is transmitted within the air layer 4, the desired illuminating angle α is obtained after refraction due to the difference between the refractive index of the member forming the case 32 and the refractive index of the air.

Light that passes through the air layer 4 with the illuminating angle of α reaches the second optical means 5. In the present invention, the second optical means 5 is a typical positive lens, i.e. in this embodiment the second optical means 5 comprises a convex lens surface 5*a* facing the first optical means 3 and a prismatically cut surface 5*b* on the light-emitting side of the second optical means 5 for obtaining appropriate diffusion of light through a three-dimensional combination of a plurality of flat surfaces such as those seen in gemstones.

The diameter D of the convex lens surface 5*a* is basically within the angle range a of luminous flux transmitted from the first optical means 3 and it is preferable to set the diameter D to be as large as is permitted. The focal point of the second optical means 5 is in the vicinity of the LED chip 2 and substantially coincides with the vertex of the illuminating angle α.

Light emitted at the illuminating angle a from the first optical means 3 is efficiently taken in by the second optical means 5 and light loss in the present invention is negligible as a result of combination of the first optical means 3 and the second optical means 5. The first optical means 3 and the second optical means 5 are integrally supported together with the LED chip 2 by a housing 6 formed of opaque resin, etc. Numeral 7 in the drawings indicates a lead frame.

In the present invention, the first optical means 3 and the second optical means 5 are provided with the air layer 4 interposed therebetween. This structure enables for more flexible design of the LED lamp 1, specifically with respect to the illuminating angle α of the first optical means 3, the focal length of the second optical means 5, and a distance E between the top of the first optical means 3 and the bottom of the second optical means 5 along the axis of rotation X of the concave mirror 31.

The diameter D of the convex lens surface 5*a* of the second optical means 5 can therefore also be more flexibly designed i.e. the light-emitting area for the LED lamp 1 can be enlarged, provided that satisfying the limitations for obtaining predetermined optical properties of the LED lamp 1. Uniformity of luminance in the light emitting area is achieved by adjusting the curvature of the concave mirror 31 of the first optical means 3 or the asphericity of the dome lens 32*a*.

Light reached the convex lens surface 5*a* passes through the second optical means 5 and is then transmitted to outside from the prismatically cut surface 5*b*. If the second optical means 5 is formed to comply with light distribution characteristics of a vehicle light, light illuminated from a vehicle light comprising an array of this LED lamp 1 can also satisfy these light distribution characteristics of a vehicle light. Accordingly, the requirements for an outer lens of the vehicle light in order to form the light distribution are less burdened.

If a plurality of designs or patterns are prepared for the prismatically cut surface 5*b*, then, for example, various kinds of the second optical means 5 can be selected in line with the design of a vehicle. The vehicle light may be comprised of the LED lamps 1 having all the same configuration, or may be comprised of different kinds of the LED lamps 1 whose prismatically cut surface 5*b* have different designs or patterns.

According to the results of the trials and experimentation carried out by the inventor in order to realize the present invention, with the above described configuration, when the height F of the LED lamp 1 is set to approximately the 10 mm which is a permitted value for a light source for use in a vehicle light such as a rear lamp, the diameter D of the second optical means 5 can easily be made to be approximately 15 mm. The light emitting area of the prismatically cut surface 5*b* can be enlarged by 9 to 25 times as compared with the LED lamp of the related art.

If the same number of LED lamps are provided within a vehicle light as compared with a conventional vehicle light, it is easily achieved to make the luminance at the surface of the outer lens of the vehicle light uniform when the LED lamp 1 of the present invention is adopted therein. Moreover, it is also possible to reduce the number of LED lamps 1 that are used while satisfying regulations regarding uniformity of luminance at the outer lens surface of the vehicle light.

In FIG. 1, numeral 8 indicates an ornamental reflector formed by appropriate means such as vacuum deposition of aluminum on the inner surface of the housing 6. This ornamental reflector 8 does not directly contribute to the optical characteristics. When the LED lamp 1 is extinguished, the ornamental reflector 8 can be seen through the second optical means 5, and the ornamental reflector 8 combines with the refractive operation of the prismatically cut surface 5*b* to bring about a more aesthetically pleasing appearance. This ornamental reflector 8 may also continue on, not be separate from the concave mirror 31.

Figure 2:
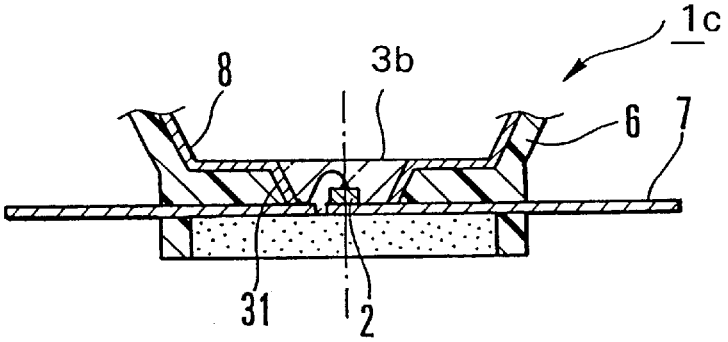
FIG. 2 is a cross-section showing the essential parts of a second embodiment of an LED lamp of the present invention.
Figure 3:
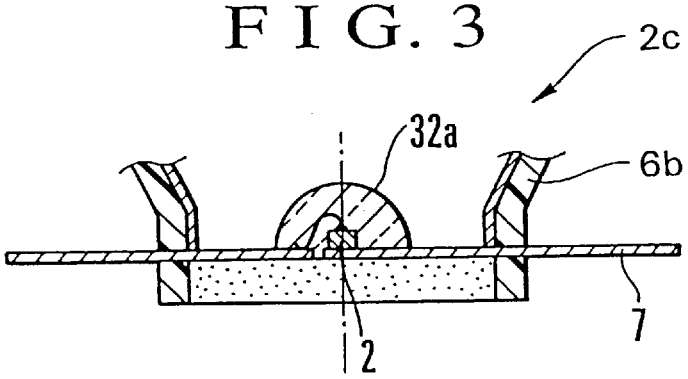
FIG. 3 is a cross-section showing the essential parts of a third embodiment of an LED lamp of the present invention.

FIG. 2 is a view showing the essential parts of a second embodiment of the present invention. In the first embodiment the concave mirror 31 and the dome lens 32*a* are used in combination as the first optical means 3 of the first embodiment, but it is also possible to use just the concave mirror 31 as in the second embodiment shown in FIG. 2, or to just use the dome lens 32*a* as shown in a third embodiment shown in FIG. 3.

Figure 4:
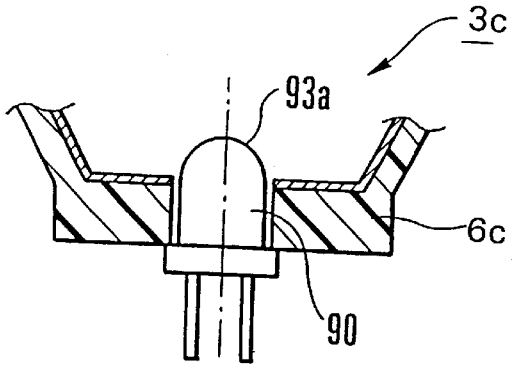
FIG. 4 is a cross-section showing the essential parts of a fourth embodiment of an LED lamp of the present invention.

When just the dome lens 32*a* is adopted as in the third embodiment, if an appropriate value can be obtained for the illuminating angle a, an LED lamp 90 of a type currently on the market can be adopted as shown in a fourth embodiment in FIG. 4 and a top part 93*a* constituting a lens portion can be used in place of the dome lens 32*a*.

Figure 5:
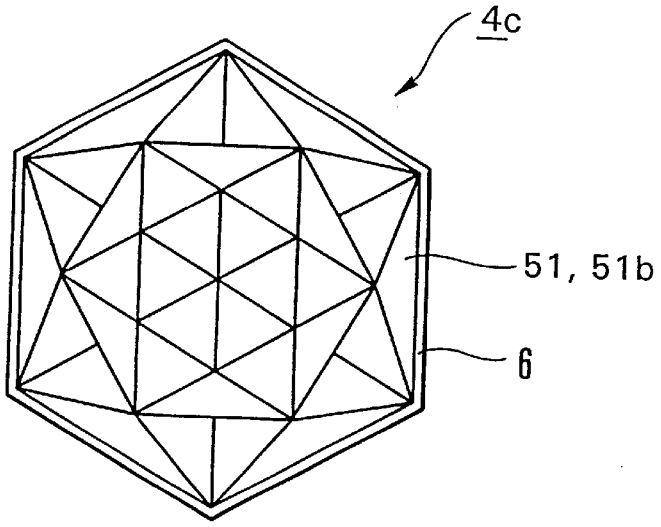
FIG. 5 is a front view showing a fifth embodiment of an LED lamp of the present invention.
Figure 6:
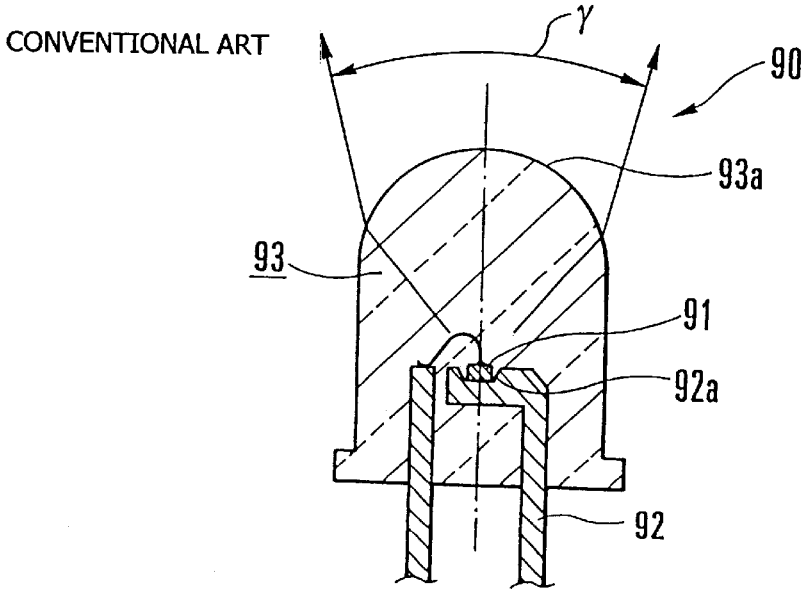
FIG. 6 is a cross-section showing a related example.

A fifth embodiment of the present invention is shown in FIG. 5. In the embodiments described previously, the front surface of the second optical means 5 of the LED lamp 1, 10, 20, 30 is circular, but the present invention is by no means limited in this respect, and the front surface 51*b* of the second optical means 51 can be a polygonal shape such as triangular, rectangular, pentagonal or, as shown in FIG. 5, hexagonal, or can be circular or elliptical. However, combinations of squares or hexagons are preferably used as a light source for a vehicle light in order to bring about the best aesthetic appearance. Since a plurality of LED lamps are aligned in combination, each element to form the second optical means 5, 51 is preferably to be such a shape that combination of the elements has beautiful appearance as a whole.

In the above embodiments, the diameter of the convex lens surface 5*a* is basically taken to be within the range of the luminous flux emitted from the first optical means 3 at the illuminating angle α, but the present invention is by no means limited in this respect. So long as 75% or more of the surface area of the convex lens surface 5*a* is covered by the luminous flux emitted from the first optical means 3, 31, 32*a*, 3*b* at an illuminating angle α, the appearance of the LED lamp 1, 10, 20, 30, 40 is not deteriorated, nor is the implementation of the LED lamp 1, 10, 20, 30, 40 hindered. The housing 6, 6*b*, 6*c* can be configured as shown in FIGS, 1, 3 and 4 respectively.

The operational advantages of the preferred embodiments of the preset invention will now be described. An LED lamp comprises first optical means and second optical means. The first optical means is for providing light, from an LED chip provided with at least one of a concave mirror and a dome lens, in an appropriate illuminating angle. The second optical means is positioned to receive light from the first optical means via an air layer and is shaped as a lens in such a manner that a composite focal point thereof substantially coincides with the position of the LED chip. At least one surface of the second optical means is a prismatically cut surface. The diameter of the light emitting surface can therefore easily be enlarged from approximately 5 mm at most in the related art to approximately 15 mm, the tendency for luminance to be large at a central line is alleviated and the luminance of the outer lens surface of a vehicle light taking LED lamps as a light source is made uniform. Visibility is therefore improved, and performance and aesthetic appearance are both improved.

Further, as the present invention provides the second optical means in addition to the first optical means, a wide variety of design changes can be catered for by preparing a plurality of designs or patterns of second optical means and then selecting which is to be used or which designs or patterns are to be used in combination. Design oversimplification that often occurred in related vehicle lights taking related LED lamps as a light source can therefore be prevented and the aesthetic appearance is improved from this aspect.

It will be apparent to those skilled in the art that various changes and modifications can be made therein without departing from the spirit and scope thereof Thus, it is intended that the present invention cover the modifications and variations of this invention provided they come within the scope of the appended claims and their equivalents.

What is claimed is:

1. An LED lamp comprising:

a first optical member for providing light, from an LED chip provided with at least one of a concave mirror and a dome lens, at an appropriate illuminating angle; and a second optical member for diffusing light from the first optical member via an air layer and shaped as a lens in such a manner that a composite focal point thereof substantially coincides with the position of the LED chip, wherein at least one surface of the second optical member is a prismatically cut surface, and the second optical member has a convex surface facing the LED chip.

2. The LED lamp of claim 1, wherein at least one type of shape that forms the second optical member is provided in a manner selectable on assembly of the LED lamp.

3. The LED lamp of claim 1, wherein the shape of the second optical member when viewed from the front is polygonal shape.

4. The LED lamp of claim 1, wherein the shape of the second optical member when viewed from the front is combination of squares.

5. The LED lamp of claim 1, wherein the shape of the second optical member when viewed from the front is combination of hexagons.

6. The LED lamp of claim 1, wherein the second optical member has a convex lens.

7. The LED lamp of claim 1, wherein the second optical member when viewed from the front is such that a plurality of shapes can be arranged close to each other.

8. The LED lamp of claim 7, wherein the shape of the second optical member when viewed from the front is polygonal shape.

9. The LED lamp of claim 7, wherein the shape of the second optical member when viewed from the front is combination of squares.

10. The LED lamp of claim 7, wherein the shape of the second optical member when viewed from the front is combination of hexagons.

* * * * *